US005327403A

United States Patent [19]

Bond

[11] Patent Number: 5,327,403

[45] Date of Patent: Jul. 5, 1994

[54] TIME INDICATING DEVICE

[76] Inventor: Anders Bond, Sågvägen 4, S-776 35 Hedemora, Sweden

[21] Appl. No.: 955,665

[22] Filed: Oct. 2, 1992

[30] Foreign Application Priority Data

Oct. 9, 1991 [SE] Sweden ..... 9102917

[51] Int. Cl.[5] ..... G04F 3/00

[52] U.S. Cl. ..... 368/107; 368/316

[58] Field of Search ..... 368/107-113, 368/316, 327

[56] References Cited

U.S. PATENT DOCUMENTS

| | | | |
|---|---|---|---|
| 2,932,779 | 4/1960 | Tancig | 368/107 |
| 4,403,869 | 9/1983 | Crutcher | 368/10 |
| 4,576,273 | 3/1986 | Milnes | 194/209 |
| 4,696576 | 9/1987 | Moore | 368/10 |
| 4,995,018 | 2/1991 | Edwards | 368/107 |
| 5,253,228 | 10/1993 | Truett | 368/107 |

FOREIGN PATENT DOCUMENTS

| | | |
|---|---|---|
| 2554468 | 8/1977 | Fed. Rep. of Germany . |
| 2749728 | 11/1978 | Fed. Rep. of Germany . |
| 381354 | 4/1974 | Sweden . |

*Primary Examiner*—Bernard Roskoski
*Attorney, Agent, or Firm*—Notaro & Michalos

[57] ABSTRACT

A device for indicating time comprises means arranged to display the number of equally large time increments of a predetermined size, for instance 15 minutes, remaining until a predetermined occurrence is intended to take place.

10 Claims, 2 Drawing Sheets

TIME INDICATING DEVICE

FIELD OF INVENTION AND PRIOR ART

The present invention relates to a device for indicating time in general and such a device adapted to assist intellectually retarded persons to orientate in the time dimension in particular.

The different devices for time indication available on the market consist of different types of clocks or watches, which indicate a numerical value of the real time by usual hands, numerals or even orally, but these numerical values of the present position in a time variable being theoretically defined are very difficult to interpret for intellectually retarded persons, which have a reduced capacity to handle abstract information. Only few of those belonging to this group of disabled persons may use watches as a means for orientation in the time dimension.

Accordingly, it is important that intellectually retarded persons with the problem in question have a possibility to judge the length of time remaining until something special is intended to take place, so that they know what they manage to do before this occurrence and manage to be in time for the happening of said occurrence. However, this may not be achieved by those pieces of time information which are provided by a time indicating devices hitherto known, since a number of intellectual operations are required, which most of the intellectual retarded persons have difficulties to carry out, in order to give them an experience with meaning of the time remaining until a certain occurrence is intended to take place. The occurrence waited for has on one hand to be given a numerical value on the time scale, and the value read on the clock has on the other to be subtracted from this value. In order to experience distances on the time scale it is also required that a result of this mathematical operation is connected to the experience of that individual from possible activities and events which may be included within this time frame.

This chain of abstract operations comprises several steps which explain the difficulties of intellectually retarded persons to planning time and be in time.

SUMMARY OF THE INVENTION

The object of the present invention is to provide a device for indicating time, which finds a remedy to the inconveniences mentioned above of the prior time indicating devices and makes it possible to intellectually retarded persons to orientate themselves in the time dimension in a satisfying manner so as to plan their time and be in time for certain occurrences.

This object is according to invention obtained by providing a device of this type with means adapted to display the number of equally large time increments of predetermined size, e.g. 15 minutes, remaining until a predetermined occurrence is intended to take place.

Thanks to the fact that a time indicating device inform the intellectual retarded person about how many time increments of a predetermined size remain until an occurrence is intended to take place, this person must firstly not subtract time values any longer, but direct information about a time distance to said occurrence is obtained, and secondly it is an aid to the intellectually retarded persons that the amount of time remaining until said occurrence will take place is expressed through a specific number of time increments, which counteracts the difficulties of that person to handle variables varying continuously. The person may thanks to the time indicating device according to the invention also as the times go learn the meaning of such a time increment, because he may couple it together with any daily duty or work, so that he knows what he typically manage to carry out during the progress of such a time increment.

The size of such a time increment is preferably chosen so that an intellectually retarded person really manage to carry out any daily work or business during one or more such time increments, for instance manage to have breakfast during one and go shopping during two such. It has turned out that about a quarter of an hour, i.e. 15 minutes, is a very suitable size of such a time increment.

The device has according to a preferred embodiment of the invention a clock following real time and an apparatus arranged to compare the time for the occurrence with the real time delivered by the clock thereto and divide the time difference so obtained into said time increments for indicating the number thereof by said displaying means. Preferably, the device comprises also a card with markings so as to indicate the time at which the occurrence is intended to take place to the apparatus and a means for reading this time and sending information thereabout to said apparatus. This card may be provided with a symbol or a picture making it possible to the retarded person to understand which occurrence is intended to take place when the number of time increments displayed by the device has expired.

The device comprises according to a further preferred embodiment an alarm arrangement for emitting an auditive signal at the time for said occurrence. The person gets in this way a last reminder telling him that the expected occurrence does now take place and it is now time to make possibly preparations therefor, such as turn the television set on, start filling the bath or the like.

Further advantages as well as preferred features of the invention will appear from the following description and the other dependent claims.

BRIEF DESCRIPTION OF THE DRAWINGS

With reference to the appended drawings, below follows a description of a device according to a preferred embodiment of the invention cited as an example.

In the drawings.

DETAILED DESCRIPTION OF A PREFERRED EMBODIMENT OF THE INVENTION

Figure 1:
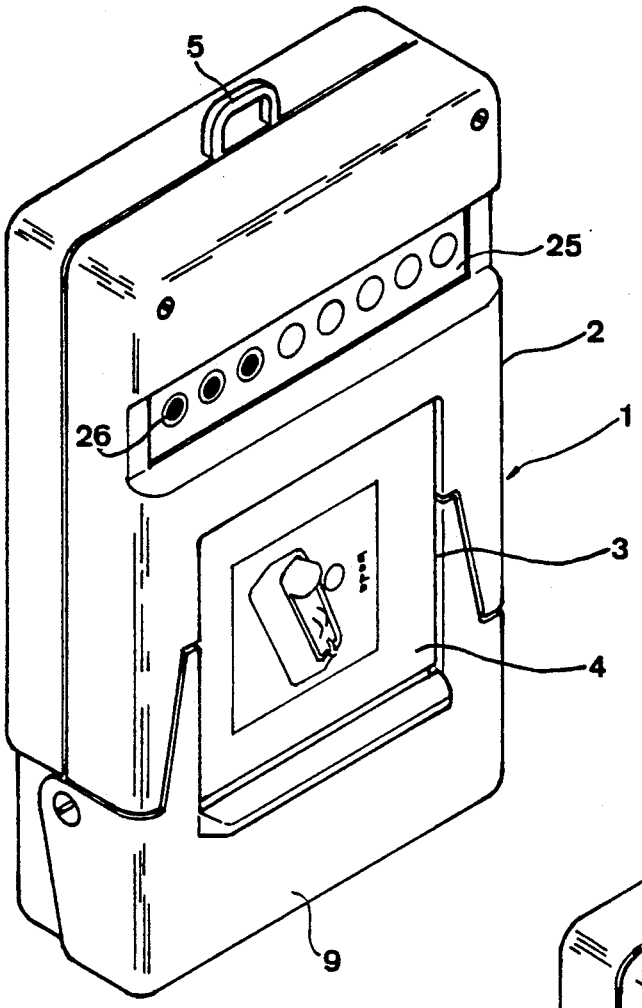
FIG. 1 is a perspective view of the device according to the invention in an operative position.

A time indicating device 1 according to the invention is shown in FIG. 1 and it consists of a box-like housing 2 and a card 4 receivable in a recess or opening 3 thereof. The housing 2 has preferably a size substantially corresponding to a conventional wallet, so that a person may carry the device along in a trouser-pocket or jacket-pocket. The housing is also provided with an eye 5, which makes it possible to hang the device at a suitable place through a string or the like.

Figure 2:
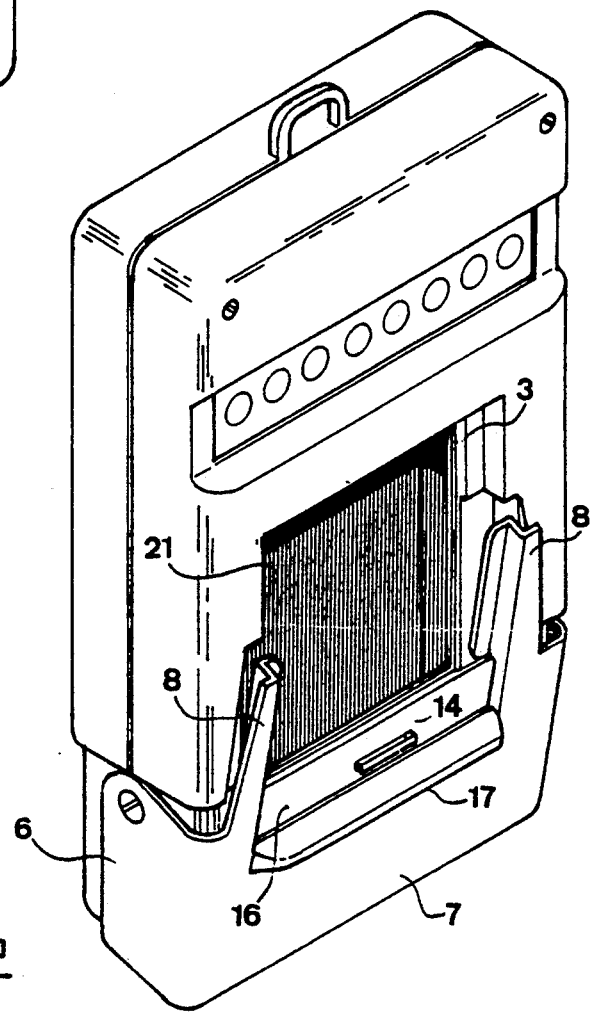
FIG. 2 is a perspective view of the device shown in FIG. 1 in a non-operative position.
Figure 3:
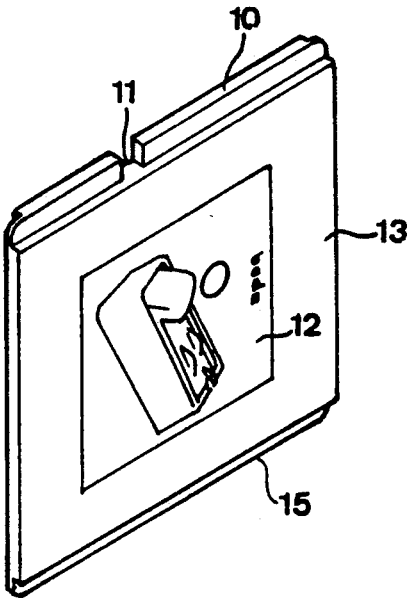
FIG. 3 is a perspective view from the front of a picture card included in the device according to the invention.
Figure 4:
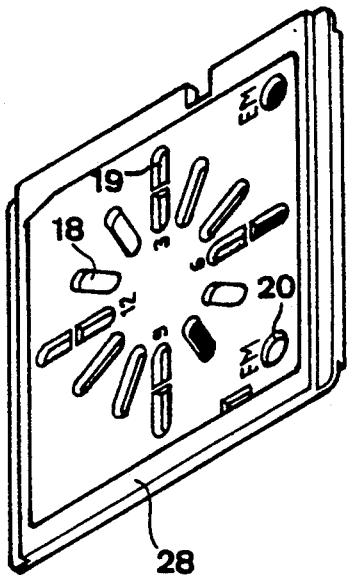
FIG. 4 is a perspective view from behind of the picture card.

Reference is now also made to FIG. 2–4. A frame part 6 is arranged at one end of said housing, has two extensions 8 projecting substantially parallely to each other from a base portion 7 and pivotably arranged at the rest of the housing about an axis being substantially perpendicular to the lateral walls of the housing. Pressing onto the base portion 7 from the housing front side 9 shown in FIGS. 1 and 2 causes pivoting of the frame part 6 about said axis with the extensions 8 outwardly from the housing so that the position according to FIG. 2 is obtained. A card as illustrated in FIG. 3 and 4, which is arranged in the recess 3 provided in the front side of the housing, may in this position jump out by the end thereof turned towards the base portion and be taken out of the latter. The card has for inserting into said recess ribs 10 arranged at two opposite sides thereof and designed to be inserted into corresponding receiving slots in the delimiting walls of the housing surrounding the recess 3. The rib on one side of the card is divided into two rib parts by a cut 11, which serves to ensure that the card is correctly turned when inserted into said recess 3. The card 4 is arranged to be inserted into the recess 3 from the frame parts end with a front side 13 provided with a symbol 12, here for bathing, turned outwardly, so that the end provided with the cut 11 is inserted into a corresponding receiving slot at the end of the recess 3 remote from the frame part end. This slot has a shoulder (not shown) designed to fit into the cut 11 of the card. At the opposite end of the recess 3 there is a rib 14 arranged to come to bear against the opposite rib 15 of the card so as to hold this in place. The base portion 7 will by pivoting the frame part 6 back into the position according to FIG. 1 together with an internal wall 16 of the housing form a channel receiving the rib 15 of the card, so that the card is retained in place in the recess 3 of the housing. Pictures from the so-called Pictogram-series consisting of pasted marks with the size 3×3 centimeters may advantageously be pasted onto the card.

The frame part 6 is spring-loadedly connected to the rest of the housing by a traction spring arranged inside the housing, so that the frame part 6 strives after assuming the rest position shown in FIG. 1. A projecting rib 17 is arranged on the frame part 6 so as to constitute an abutment for a rib 15 of the card, so that in the position of the housing according to FIG. 1, but without any card, a card may be laid on the top of the recess 3 and be pressed into the recess by displacement of said rib 15 on the rib 17 on pivoting of the frame part to the position according to FIG. 2, whereupon said traction spring ensures that the frame part pivots back and the card is snapped in locked to the housing.

A card may in the way described above easily be inserted into the retainer formed by the frame part 6 and the recess 3 of the housing or be taken out thereof and replaced by another card.

Markings for indicating a certain time are arranged on the rear side 28 of the card. These markings consist of recesses made in the card, which comprises twelve recesses 18 pointing like hour hands, four minute hand recesses 19 indicating whole quarter hours in the prolongation outside thereof and distributed at every third of the former as well as two recesses 20 for indicating a.m or p.m. The time indication for the occurrence of the event shown on the front side of the card is obtained on the rear side of the card by filling in the recesses 18–20 in question by a suitable Indian ink pen. The time is by doing so indicated by whole quarters of an hour. Half past seven a.m, i.e. in the evening, has in this way been indicated in FIG. 4.

A preferably partially transparent disc 21 is arranged in the recess 3 of the housing so as to delimit the interior of the housing with respect to the environment. Means not shown for optically detecting the time indicated on the rear side of the card received in the recess of the housing are arranged behind said disc 21. Such a reading may for example be accomplished by emitting light towards the rear side of the card and making it to be reflected thereby, whereupon the light reflected is analysed. The light intensity may then be different where the recesses in the card have been filled in by the pen. It is of course also possible that contrary to what is shown in FIG. 4 all recesses are dark in their starting state and light markings are carried out by means of the pen.

Figure 5:
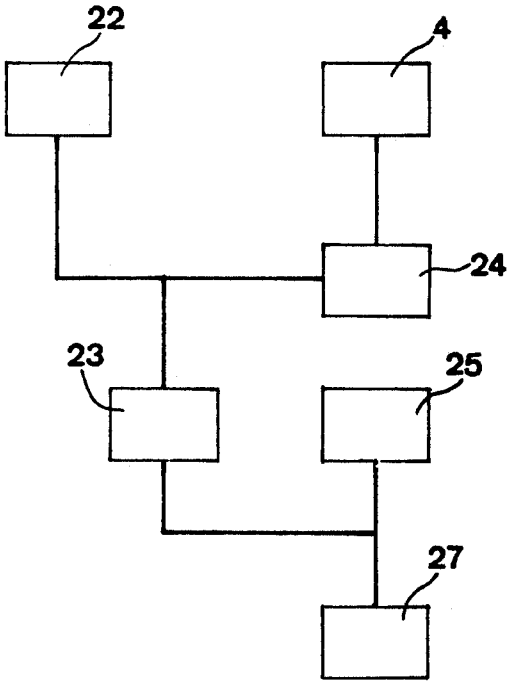
FIG. 5 is a block diagram schematically illustrating the function of the device shown in FIG. 1.

It is now also referred to the block diagram of FIG. 5. A clock 22 following real time is arranged inside the housing 2 and to deliver information about the real time to a comparing apparatus 23 also arranged inside the housing. The detector 24 registering the time indication on the rear side of the card is also arranged to deliver information about the detected time to the comparing apparatus 23. This apparatus is adapted to compare the time for the occurrence indicated on the front side of the card with the real time delivered by the clock and divide the time difference so obtained into time increments, here quarters, i.e. periods of 15 minutes, which are of such a size that they are easy to understand for an intellectually retarded person, since such a period corresponds to a time during which smaller daily duties usually may be carried out.

The comparing apparatus 23 has also control means arranged to send control signals to a set 25 of eight light emitting members 26. The light emitting members 26 are arranged on a line visible on the front side of the housing, and the signal from said control means causes that number of light emitting members to shine which corresponds to the number of time increments remaining until the occurrence marked on the card is intended to take place. All eight light emitting members 26 are shining as long as eight time increments, i.e. two hours, or more remain until said occurrence. A control means is adapted to start a countdown when the time difference between the real time and the time marked on the card falls below two hours by switching a further light emitting members off at each change of the number of remaining time increments, the last light emitting members being switched off when the time difference is gone, but it would also be possible to construct the device so that this takes place when the time difference is exactly 15 minutes, i.e. the displaying means 25 is arranged to indicate the number of time increments calculated by the apparatus 23 remaining until the occurrence is intended to take place rounded off downwardly to the next integral number, so that the displaying means is arranged to permanently indicate the time at least remaining until said occurrence is intended to take place. Furthermore, an alarm arrangement 27 is arranged inside the housing to receive a control signal from a control means of the comparing apparatus 23 so as to emit an auditive signal at the same time as the last light emitting members 26 is switched off. The attention of the person using the time indicating device is in this way called to the fact that the occurrence in question now will take place. The clock or the means controlling the light emitting members and the alarm arrangement may be adjusted so that a predetermined time delay is established in the sense that it remains for example a minute more than shown each time a lamp is switched off or the alarm goes. The presence of the alarm apparatus also enables the use of the time indicating device as alarm clock by inserting a card on which a time suitable for getting up is indicated into the recess 3 of the housing.

Means are preferably arranged for controlling the reading means 24 to automatically make a reading of time information on the card as soon as this has been inserted into the retaining means.

The time indicating device described above may be used in the following way. Intellectually retarded persons should have a number of picture cards 4 suitable to their needs and their ability representing important occurrences, "day center starts", "bus time", "TV-programme starts" and so on. By using a picture of the occurrence of interest a picture of the time remaining until that occurrence is intended to take place is obtained in the form of a number of shining light points. If all eight light points are shining a very long time remains, but if only one is shining the occurrence is soon there. It is also possible to let the picture remain there in order to see how the time goes, i.e. disappears.

It would of course then be desirable to obtain a standard of showing "remaining time" as a number of light points, each of which light points corresponds to a quarter. Intellectually disabled persons may in this way already in the special school get used to see time as a number of light points and by that early begin to train the capacity to "feel" how long a quarter is. This time display could after that be present on day centers, places of work and so on.

The use of the device according to the invention will of course be very varying depending on the ability of the user. It may for example for an individual take place according to the following:

The user lays a "get up picture" on at bed time. If he becomes awake before the clock rings he may see if a long time remains and then calmly fall asleep again. The clock sounds when it is time to get up. The user lays then the "bus departure picture" on, whereupon four light points shine, so that he knows that he has plenty of time for carrying out his toilet, get dressed, have breakfast and the like. He knows that he has to take his outdoor clothes on when the clock sounds so as to go to the bus.

At the arrival at the day center he may lay the picture symbolizing "lunch" on and by that get an idea of how much time remains until lunch.

He may in the same way have more pictures symbolizing occurrences returning daily, such as "homeward journey", "TV-news" and so on. On special occasions, for instance an ice-hockey match on TV, the staff at the day center may easily fill in the picture card with the time "half past eight" and put on (or draw up) a picture symbolizing ice-hockey. The user may by that by himself understand that he manage to take a walk before the match.

If the user wants to go fishing for a while before dinner, a father or mother may fill in the suitable time for returning home and paste on a symbol for "go home". The user can the whole time see how much time remains until the dinner. Should he be so occupied by the fishing that he forgets to look at the clock a reminding signal will be emitted when the last light point is switched off.

When returning home in a light summer evening the user may lay on the "TV-news" picture. He does then see how much time remains until the news program or that it has been past and may in that way orientate himself in the time dimension.

Thus, the requirement of handling symbolic time values, as for instance hours and minutes, disappears through the device according to the invention and the time for an occurrence is instead represented by pictures which the user may choose himself. The device calculates the time distance to the occurrence in question and eliminates by that the need of subtracting time values. Furthermore, the time distance is made concrete by that the time "disappears" in the same way as in hour-glasses and water-clocks of old times. The difficulty of intellectually retarded humans to decide whether it is much or little left of anything changing gradually, for instance a clock hand, is furthermore considered by expressing the amount of time through a number of time intervals of determined size. By the choice of the size of a time increment so that many every day activities and occurrences may be represented by a handy number of points, the learning of how much time different activities usually take is facilitated. Furthermore, intellectually retarded persons using the time indicating device according to the invention have the possibility to gradually, in their own time, learn to utilize the possibilities of the device. The easiest use, which consists in using the device as an aid so as to be in time, may gradually be developed into a use for planning in the time dimension.

Thanks to the pedagogical construction of the card (a common clock on the rear side) the ability to understand and utilize common clocks and also to learn to recognize certain times from a model (for instance TV-times from a special paper) is trained. The simplicity to fill in a time on the card by means of a pen makes it also very easy to programme a time, since no strange presses of buttons are needed.

The invention is of course not in any way restricted to the preferred embodiment described above, but several possibilities to modifications thereof would be apparent to a man skilled in the art without departing from the basic idea of the invention.

All the light emitting members may for example be switched off when a long time remains until the occurrence indicated on the card is intended to take place and be switched on one after the other, so that all light emitting members are switched on when there is less than one time increment remaining until the occurrence. The definitions light emitting members is intended to comprise all types of members emitting a light different from the environment, thus for instance also dark points, stars and the like on a panel for display by means of liquid crystals.

The housing of the device could of course have any other suitable shape, and it is not necessary that the device is movable, but it is well conceivable that it is hung on the wall in a day centre so as to indicate the time remaining until for instance the common lunch is served and so on to the persons being there.

I claim:

1. A device for indicating a time remaining for an occurrence, the device comprising:

a clock for indicating time;

informing means for setting a time for an occurrence;

comparing means communicating with the clock and the informing means for continuously determining the difference between the indicated time of the clock and the time for the occurrence of the informing means, the comparing means dividing the difference into time increments remaining until the occurrence takes place;

said informing means comprising a card having markings on a side of the card for indicating a time for an occurrence and means for reading the time for the occurrence and sending the time for the occurrence to the comparing means, said card having a clock-face-like appearance, and the markings comprising a plurality of hour positions, a plurality of minute positions, an a.m. position and a p.m. position, the informing means also including reading means for optically reading said markings on the card;

displaying means communicating with the comparing means for displaying the time increments remaining until the time for the occurrence has been reached, the displaying means displaying a number of mutually spaced markings corresponding to a number of time increments remaining until the occurrence takes place, the displaying means further comprising a plurality of light emitting members, and including control means for controlling a switching on and a switching off of the light emitting members of the displaying means depending on the remaining time increments until the occurrence takes place, said control means being arranged to control the displaying means in order to activate a number of light emitting members corresponding to a number of time increments remaining until the occurrence takes place, said displaying means being adapted to continuously indicate the number of time increments remaining until said occurrence takes place, the displaying means performing a countdown each time a time increment expires; and a housing for containing the clock, informing means, comparing means and displaying means, the housing having means for receiving and retaining said card such that the markings on the side of the card are directed inwardly towards an interior of the housing and an other side of the card is directed outwardly from the housing, said other side being adapted to receive a symbol for representing said occurrence, said means for receiving and retaining said card comprising a recess in said housing for receiving, engaging and holding at least one end of said card, and a frame part movably mounted to said housing for holding an opposite end of said card in said recess in a first position of said frame part, and for releasing said opposite end of said card and moving said card out of said recess in a second position of said frame part.

2. A device according to claim 1, wherein said card includes a first card rib at said first one end of said card, and a second card rib at said opposite end of said card, said recess including a slot for receiving said first card rib, said frame part including a base portion for engagement against said second card rib to hold said card in said recess with said frame part in said first position, and a pair of spaced apart parallel extensions extending from said base portion on opposite sides of said recess with said frame part in said first position, said extensions engaging and moving said card out of said recess when said frame part moves into said second position.

3. A device according to claim 2, wherein said base portion includes a base rib against which said second card rib is slidable for causing movement of said frame part from said first position to said second position as said card is moved into said recess.

4. A device according to claim 3, wherein said housing includes a housing rib adjacent said recess for engaging said second card rib when said card is in said recess, said housing rib being covered by said base portion of said frame part when said frame part is in said first position.

5. A device as claimed in claim 1, wherein said housing is adapted to permit a changing of the card for another card representing another occurrence.

6. A device as claimed in claim 1, wherein the markings are made by means of a pen.

7. A device as claimed in claim 1, wherein said reading means is adapted to automatically read the time for the occurrence on the card as soon as the card is inserted into the retaining means of the housing.

8. A device as claimed in claim 1, wherein the control means is arranged to keep all of the light emitting members in a same function state when the remaining time increments until the occurrence takes place exceeds or is equal to the number of light emitting members.

9. A device as claimed in claim 1, including an alarm means for emitting at least one auditive signal just before or when the time for the occurrence has been reached.

10. A device as claimed in claim 1, wherein said displaying means is arranged to display a number of 15 minute periods remaining until the occurrence takes place.

* * * * *